US008555936B2

(12) United States Patent
Gotoh et al.

(10) Patent No.: US 8,555,936 B2
(45) Date of Patent: Oct. 15, 2013

(54) CONTAINER FOR REFILL

(75) Inventors: Masashi Gotoh, Tokyo (JP); Takashi Terayama, Tokyo (JP); Noriyuki Sasaki, Tokyo (JP); Takeshi Saitoh, Tokyo (JP); Daiji Takeuchi, Tokyo (JP); Toyoaki Naitoh, Tokyo (JP)

(73) Assignees: Nestec S.A., Vevey (CH); Toppan Printing Co., Ltd., Tokyo (JP)

( * ) Notice: Subject to any disclaimer, the term of this patent is extended or adjusted under 35 U.S.C. 154(b) by 477 days.

(21) Appl. No.: 12/989,313

(22) PCT Filed: Apr. 24, 2009

(86) PCT No.: PCT/EP2009/054984
§ 371 (c)(1),
(2), (4) Date: Oct. 22, 2010

(87) PCT Pub. No.: WO2009/130315
PCT Pub. Date: Oct. 29, 2009

(65) Prior Publication Data

US 2011/0036868 A1 Feb. 17, 2011

(30) Foreign Application Priority Data

Apr. 24, 2008 (JP) ..... 2008-114572

(51) Int. Cl.
*B65D 51/20* (2006.01)

(52) U.S. Cl.
USPC ..... 141/332; 141/5; 141/83; 141/335; 141/338; 141/344

(58) Field of Classification Search
USPC ..... 141/5, 83, 329–330, 331, 332, 335
See application file for complete search history.

(56) References Cited

U.S. PATENT DOCUMENTS 6,527,110 B2 * 3/2003 Moscovitz ..... 206/222
6,533,113 B2 * 3/2003 Moscovitz ..... 206/222

(Continued)

FOREIGN PATENT DOCUMENTS

| | | |
|---|---|---|
| EP | 2008553 | 12/2008 |
| FR | 2666566 | 3/1992 |
| JP | 6324464 | 11/1994 |
| JP | 0858764 | 3/1996 |
| JP | 2002264918 | 9/2002 |
| JP | 2007290373 | 11/2007 |

OTHER PUBLICATIONS

PCT International Search Report for Application No. PCT/EP2009/054984 mailed on Jul. 16, 2009.

*Primary Examiner* — Gregory Huson
*Assistant Examiner* — Nicolas A Arnett
(74) *Attorney, Agent, or Firm* — K&L Gates LLP

(57) ABSTRACT

The invention aims at providing a container for refill that enables transfer of the contents with one action and successfully secure the self-supporting property of the container for allowing the safe transfer. The opening portion (2A) of body (2) of a cup-shaped container is provided internally with a hopper (3) tapering toward the opening portion (2A). Ribs (12) are integrally provided between the outside of the hopper (3) and the inside of a ring (3A) and arranged circumferentially at predetermined intervals. Height H from the top surface of the rib (12) to the opening (3C) of hopper (3) is approximately a quarter or more of diameter ϕ of the opening (3C) of hopper (3). A lid (4) tearable by pressing is attached to the opening portion (2A) so as to enable the instant coffee P to be directly supplied through the mouth (13A) of a refillable container (13) while being gathered to a central portion by the hopper (3) by inverting the container body (2) and pressing the lid (4) against the mouth (13A) of container (13) to tear the lid (4).

8 Claims, 7 Drawing Sheets

(56) References Cited

U.S. PATENT DOCUMENTS

| | | | | |
|---|---|---|---|---|
| 6,935,493 | B2 * | 8/2005 | Cho | 206/222 |
| 6,974,024 | B2 * | 12/2005 | Cho | 206/219 |
| 6,994,129 | B2 * | 2/2006 | Fesko | 141/330 |
| 6,994,211 | B2 * | 2/2006 | Cho | 206/221 |
| 7,635,012 | B2 * | 12/2009 | Johns et al. | 141/322 |
| 7,886,779 | B2 * | 2/2011 | Smith | 141/23 |
| 2003/0017236 | A1 * | 1/2003 | Makita et al. | 426/115 |
| 2005/0092391 | A1 * | 5/2005 | Fesko | 141/331 |
| 2011/0036454 | A1 * | 2/2011 | Saito et al. | 141/331 |
| 2011/0192491 | A1 * | 8/2011 | Luchinger et al. | 141/5 |

* cited by examiner

CONTAINER FOR REFILL

The invention is for refilling with powder, granular material, etc. and relates to a paper container for refill comprising a cup-shaped container body mainly made of paper, a hopper mounted on the opening portion of the container body, and a sealing lid for closely sealing the opening portion.

In the paper container for refill according to the invention, the hopper is tapered toward the opening portion for convenience of transferring the contents such as instant coffee and formed of a material such as synthetic resin materials, more specifically, a high-density polyethylene (HDPE), or the same paper as that of the container body. For conventional containers for refill, packaging bags made of a synthetic resin film are often used. Examples of such containers are pouches packing retort food or self-supported gusset bags with a zipper for re-closure on their upsides. On the other hand, as a conventional structure having a ring inside of the opening portion of the container body, there is one mainly intended to improve the strength of the container. More specifically, a flange of the ring is mounted on the top surface of a flange or curl portion formed by outwardly extending the upper end of the middle of the container body, and the top surface of the flange of the container body is joined to the bottom surface of the flange of the ring. Furthermore, a sheet-like lid with barrier property may be attached to the top surface of the ring flange and a cap may be mounted to closely seal the opening portion of the container body, like in the following Japanese publications: Patent Application Publication No. 2007-290373, Examined Patent Application Publication No. 63-24464, Patent Application Publication No. 08-58764, Patent Application Publication No. 2002-264918.

However, the above conventional structures have problems in refilling with the contents such as instant coffee that it is necessary to preliminarily unseal the gusset bag or containers and that the refill operation is very troublesome because the contents easily spill during the refilling. Furthermore, there are other problems that, upon the refilling, the contents such as instant coffee are exposed to the air to degrade the aroma or flavor of the contents and that the contents absorb the moisture in the air. In particular, the pouches or gusset bags are unsealed by cutting their edges using scissors or the like and, thereafter, stand the pouches or gusset bags on the refillable container in an inverted position to transfer the contents. Thus, two actions are necessary for the transfer. Furthermore, there is also a problem that the contents cannot be smoothly transferred unless the bag is expanded by introducing the air into the bag, for example.

To solve these problems through various analyses, it is an object of the invention to provide a paper container for refill that allows easy and reliable refill operation reduces the risk of degrading the aroma or flavor, enables transfer of the contents with one action, and successfully secures the self-supporting property of the container to achieve safe transfer.

The present invention concerns a container for refill comprising:

a container body presenting an opening portion, a hopper assembly placed integrally on the opening portion of the container body comprising a hopper tapering toward the container opening portion and said hopper assembly being provided with ribs extending from an outer circumferential wall of the hopper assembly to the inner tapering wall of the hopper and arranged circumferentially at intervals, the height from the upper ends of the ribs to the upper edge of the hopper opening being approximately a quarter or more of the diameter $\phi$ of the hopper opening, a tearable sealing lid closing the container body opening portion.

According to a specific embodiment, the hopper is provided integrally with a tubular member on an end of its tapered opening, the tubular member extending axially with the same internal diameter $\phi$ as the end of the tapered opening.

According to the preferred embodiment of the present invention, the outer circumferential wall of the hopper assembly is a ring, the ring having an outer shape with a dimension substantially the same as the inner diameter of the container opening portion, thereby enabling the hopper to be mounted by attaching the ring to the inner surface of the container opening portion. The ring can be attached on an edge of the hopper nearer to the interior of the container body.

The hopper assembly can be made of paper or resin material such as high-density polyethylene (HDPE) or polypropylene. The container body is preferably made of paper.

The hopper assembly preferably comprises at least 3 and at most 8 ribs. Generally the ribs are formed integrally with the hopper and the outer circumferential wall. It means that the ribs, the hopper and the outer circumferential wall are made of a single piece of material.

According to an embodiment of the present invention, the paper container for refill comprises:

a cup-shaped container body made mainly of paper, and a hopper provided integrally on an opening portion of the container body and tapering toward the opening portion, the hopper being provided integrally with ribs extending from an outer circumferential wall of the hopper to an inner circumferential wall of the opening portion and arranged circumferentially at predetermined intervals, the height from the upper ends of the ribs to the upper edge of the hopper opening being approximately a quarter or more of the diameter of the outlet of the hopper, a sealing lid tearable by pressing being attached to the opening portion, thereby enabling contents to be directly supplied through a mouth of a refillable container while being gathered to a central portion by the hopper by inverting the container body and pressing the lid against the mouth of the refillable container to tear the lid.

According to the invention, the container for refill according to the present invention comprises a container body preferably made mainly of paper and a hopper provided integrally on an opening portion of the container body and tapering toward the opening portion. By "provided integrally on an opening portion of the container body", it is meant that the whole hopper is placed inside the container body. The container preferably presents a cup or circular shape. The hopper preferably presents a circular opening too. The hopper assembly is provided, preferably integrally, with ribs extending from an outer circumferential wall of the hopper to an inner circumferential wall of the hopper opening and arranged circumferentially at predetermined intervals. The height from the upper ends of the rib to the upper edge of the hopper opening is approximately a quarter or more of the diameter of the outlet of the hopper, the hopper opening being preferably circular. A tearable sealing lid is attached to the hopper opening. The lid simultaneously closes the hopper opening and the container opening. The lid is preferably tearable by pressing. It enables the container contents to be directly supplied through the mouth of a refillable container while being gathered to the centre of the hopper by inverting the container body and pressing the lid against the mouth of the refillable container to tear the lid.

The container for refill configured as mentioned above can include an overlying cap for protecting the interior. In practice this cap is removed and the container body is inverted, and then the hopper is mounted on a position where the hopper can internally fit with the mouth the refillable container, which can for example be a jar. The powder or bulk material, such as instant coffee, present in the container body flows down into the hopper, but is retained by the lid. Thereafter, a pressing force is applied against the container body so as to push the hopper toward the mouth of the jar. This pressing force acts as a force allowing the mouth of the jar, which is, in general, a tubular portion cylindrically, upwardly extending from the body jar, to press and tear the lid. Consequently, it acts as a force allowing the mouth of the jar to push the lid upward and force the lid into the space which defined a triangular section between the container body peripheral wall and the hopper internal wall. The lid to which the pressing force is applied is torn and divided into a plurality of pieces along, for example, radial perforations or cutting lines which are the weakened portions preliminarily provided in the lid. At the same time, the hopper enters the mouth of the jar. Consequently, the opening of the hopper is unsealed and the powder such as instant coffee flows from the container body down into the jar while it is guided to the center by the hopper.

According to the invention all the ribs present preferably the same shape and size. In particular, for this invention, the height from the upper ends of the ribs provided on the outside of the hopper at predetermined intervals in the circumferential direction to the upper edge of the hopper opening is set at about a quarter or more of the diameter of the hopper opening and preferably up to half said diameter. Then, the torn pieces of the lid can recede laterally and outwardly from above the hopper outlet by pushing the hopper opening at least from the opening of the container body by at least a quarter of the diameter of the hopper opening.

Furthermore, the ribs arranged in the circumferential direction abut the upper edge of the mouth of the refillable container to successfully support the refill container and maintain its pushed position.

Thus, the invention has the advantageous effects as follows.

The container for refill according to the invention allows the lid to be pressed and torn by pressing the container body against the mouth of the refillable container so that it is easy to cause the container body to directly communicate with the refillable container, absolutely unlike the conventional standing pouches. Thus, it is possible to easily and reliably perform refilling with a very simple operation and it is unlikely to expose the contents to the air and to degrade the aroma or flavor.

In particular, for this invention, the pushing length enabling the torn lid pieces to recede laterally and outwardly from above the outlet of hopper is set at least a quarter of the diameter of the hopper opening and, therefore, the torn lid pieces can appropriately recede laterally and outwardly from above the hopper outlet and it is possible to achieve smooth transfer of the contents. Furthermore, the ribs arranged at predetermined intervals in the circumferential direction abut the upper edge of the mouth of refillable container so that the refill container is successfully supported and the pushed position is maintained, thereby enabling stable transfer of the contents with one action.

In the above structure, it is preferable that the hopper is provided integrally with a tubular member or guide on an end of the hopper tapered opening and the tubular member extends axially with the same internal diameter as that of the end.

Whereas the hopper tends to abut the mouth of the refillable container on its slanted wall to make the abutting position unstable in some cases, the tubular member connected to the hopper can be reliably inserted into the mouth of the refillable container as a straight tubular guide. Thus, it is possible to guide the powder into the mouth of refillable container, to suppress scattering of the powder outside of the container and exposure of the powder to the air or the moisture during refilling, and to reduce the risk of degrading the aroma. In particular, it is effective to use the tubular member for powder easily influenced by the air or the moisture.

Furthermore, it is preferable that the hopper assembly is provided integrally with a ring on an edge of the hopper nearer to the interior of the container body and the ring has the outer shape with a dimension substantially the same as the inner diameter of the container opening portion, thereby enabling the hopper to be mounted by attaching the ring to the inner surface of the container opening portion.

This is so because it is possible to attach the hopper to the inside of the opening portion of container body by adhering the ring to the inner surface of the opening portion of container body using thermal fusion bonding or an adhesive.

BRIEF DESCRIPTION OF THE DRAWINGS

The characteristics and advantages of the invention will be better understood in relation to the figures which follow.

DETAILED DESCRIPTION OF THE DRAWINGS

Figure 1:
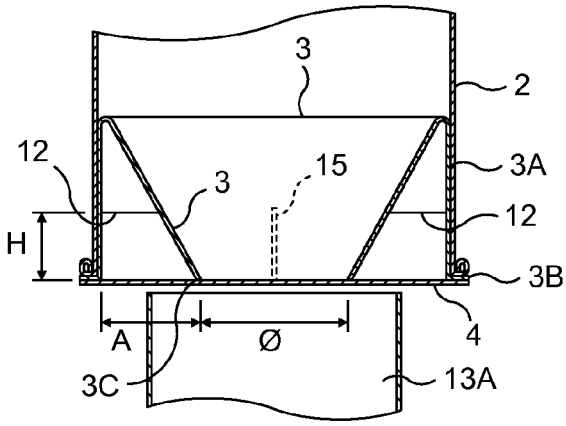
FIG. 1 is a main sectional view illustrating an embodiment of the inventive paper container for refill and characteristically showing the relationship between the lid, container and the jar before the contents are supplied to the jar.

Embodiments that apply the paper container for refill according to the invention to a container 1 for instant coffee refill will now be explained in detail referring to the drawings.

Basically, the invention can be applied to the overall embodiments that include an opening portion with a part having a hopper joined thereto and that enable the contents to be refilled efficiently. Thus, the invention is not limited to the embodiments described below.

Figure 4:
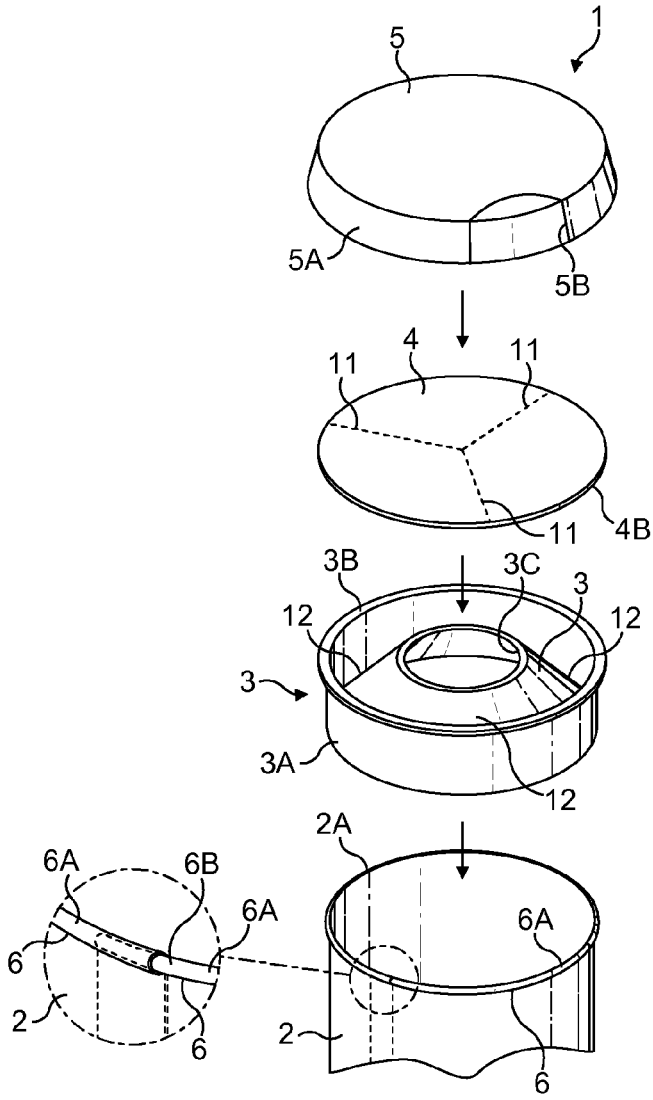
FIG. 4 is an overall exploded perspective view showing an embodiment of the inventive paper container for refill and including an enlarged view showing an enlarged part of the container.
Figure 5:
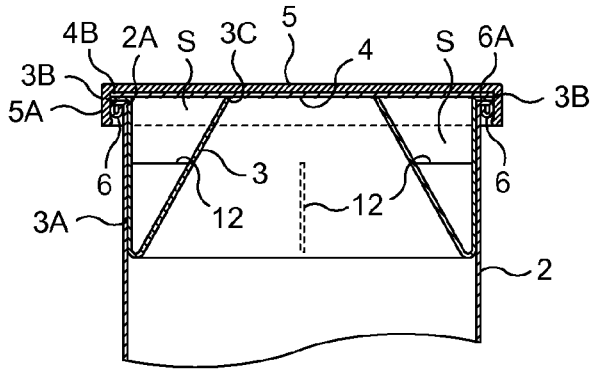
FIG. 5 is a sectional view showing an end of the container of FIG. 4 in its closed position

First, as shown in FIGS. 4 and 5, the refill container 1 consists of a container body 2, a hopper 3 as an example of a funnel, a sheet-like lid 4 with barrier property, and an overlying cap 5.

The container body 2 is in a cylindrical shape with a bottom and made of a rectangular piece of paper. This paper cylinder is formed of a composite including a paper layer, an aluminum foil layer, a polyethylene terephthalate layer, and a low-density polyethylene layer laminated sequentially from the outside and having high barrier property to gas (oxide, water vapor, or components vaporized from the contents). The art publicly known is used as means for laminating the layers. For example, a common technique such as lamination or coating is used. To produce the container body 2, a rectangular piece of paper with high gas barrier property as mentioned above is rolled into a cylinder, both the left and right ends are superposed, and the superposed portions are used as a joining part to achieve appropriate adhesion. As means for adhesion, any appropriate know art such as adhesion by an adhesive or thermal fusion bonding is used. On the upper end, as shown in FIGS. 4 and 5, a curl portion 6 that curls outwardly and annularly is formed integrally.

Figure 6:
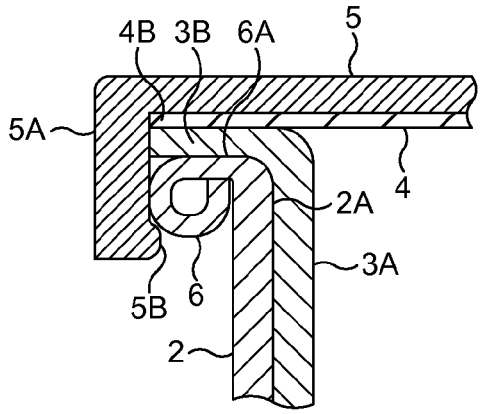
FIG. 6 is an enlarged view showing the main part of the sectional view shown in FIG. 5.

As shown in FIGS. 4-6, a hopper 3, that is, a funnel tapering toward the opening portion 2A of the container body 2 (simply "hopper" hereinafter) is fitted into an opening portion 2A of the container body 2. More specifically, the hopper 3 is made of the same material as that of the container body 2 or any appropriate resin material with a thickness of 0.8 mm such as high-density polyethylene (HDPE) or polypropylene. The hopper 3 has an upright wall 3A as a ring on its perimeter (the upright wall will be simply called a ring hereinafter). The ring 3A has a flange 3B integrally provided on its upper end and protruding outward. The ring 3A is fitted into the opening portion 2A of the container body 2 with the bottom surface of the ring 3A placed on and appropriately joined to the upper end of the opening portion 2A, that is, the upper end face 6A of the curl portion 6. The hopper 3 is also formed of a wall extending integrally from the lower end of the ring 3A and gradually, upwardly slanting toward the center. The taper angle of the hopper 3 is set in the range of at least 1-70° depending on the contents, and more preferably in the range of 10-30°. As the taper angle becomes more acute, the height (length) of the hopper 3 increases, thereby increasing the amount of the resin forming the hopper 3. Thus, the taper angle is properly set in view of costs. The upper end of the wall slanting toward the centre, that is the opening 3C, is designed to be placed at substantially the same height as that of the upper end face of the flange 3B, that is, in substantially the same plane with the upper end face 6A. Most preferable means such as thermal fusion bonding, radio frequency bonding, or adhesion by an adhesive is used as means for joining the hopper to the container body.

In the figure, 6B shows a step that occurs in the curl portion 6, but it is successfully sealed by a sealant layer 7 (mentioned hereinafter) formed in the innermost layer of the sheet-like lid 4.

The lid 4 with barrier property is hermetically adhered to the upper end of the hopper 3.

Figure 7:
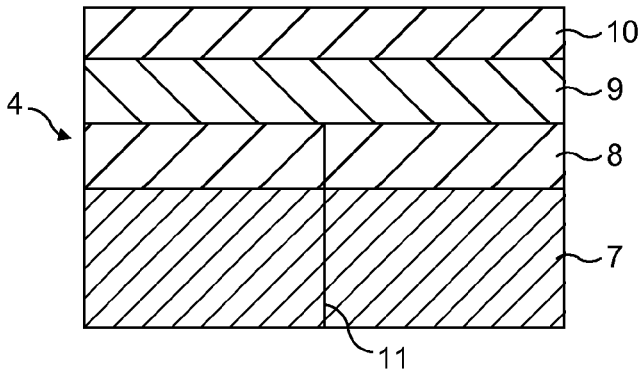
FIG. 7 is a sectional view showing the lid taken along A-A line in FIG. 8.

As shown in FIG. 7, a composite sheet with high gas barrier property having a polyethylene sealant layer as the innermost layer 7 is used for the lid 4 with barrier property. In the composite sheet, a polyethylene terephthalate layer 8 is attached to the outside of the sealant layer 7, and a metal foil film 10 is attached to the outside of the layer 8 via an adhesive layer 9. Furthermore, as shown in FIG. 8, the innermost sealant layer 7 is provided with a plurality of weakened portions 11 extending radially from its center, thereby allowing the innermost layer 7 and also the metal foil film 10 to be easily torn so as to facilitate breaking the seal.

Figure 8:
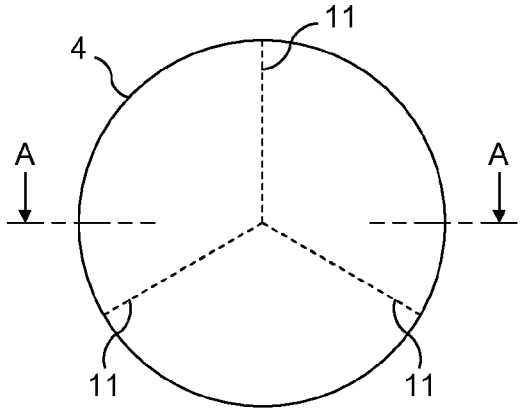
FIG. 8 is a bottom view of the lid shown in FIG. 1.

As shown in FIGS. 4, 5 and 8, the overall shape of the lid 4 is a circle with approximately the same diameter as that of the opening portion 2A of the container body 2, that is, about 90 mm, and its periphery 4B is properly attached to the top surface of the flange 3B of the hopper 3. Typically, thermal fusion bonding is performed. However, in this embodiment, the lid 4 is merely in contact with the upper end of the hopper 3 that is the upper edge of the opening 3C, so that the opening 3C of the hopper 3 can be quickly and easily unsealed.

Figure 17:
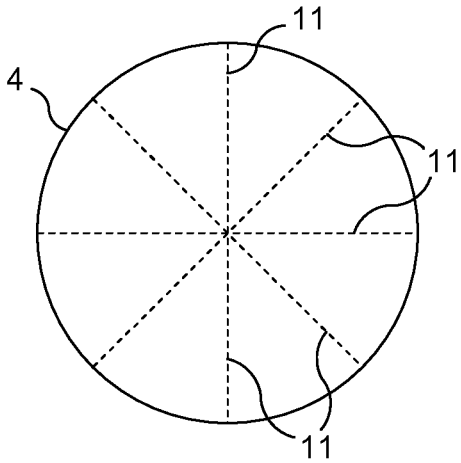
FIG. 17 is a bottom view showing the lid corresponding to that of FIG. 8 having eight weakened portions.

As shown in FIGS. 1, 4, and 5, the lid 4 with barrier property is further provided with perforations or cutting lines (perforations, in the shown example) as a plurality of weakened portions 11 extending radially from the center so that they reach the innermost layer 7 and the polyethylene terephthalate layer 8. The perforations or cutting lines as the weakened portions 11 enables the innermost layer 7 and also the metal foil layer 10 to be easily torn, thereby facilitating breaking the seal. As shown in FIGS. 4 and 8, the perforations or cutting lines are three straight lines crossing at the center, and the length of the line is 9 mm and the length of the connection is 1 mm. The number of the lines which is 3 is the minimum number to achieve the given object of the invention. Although the maximum of the number of the lines depends on the size of the lid 4, the desirable maximum is 10. If the number is 10 or more, the strength of the lid 4 may be weakened, which is not preferable. The number is ideally 3 to 8 (an example with 8 lines is shown in FIG. 17).

The overlying cap 5 is made of the same material as that of the container body 2 or an appropriate resin with a thickness of about 0.8 mm such as high-density polyethylene (HDPE) or polypropylene. As shown in FIGS. 4-6, the cap 5 externally fits with the opening portion 2A of the container body 2 to protect the lid 4 and also to keep the interior sanitary. In particular, the lower end of a peripheral downward wall 5A is provided with an undercut 5B. This undercut 5B elastically engages with the bottom surface of the curl portion 6 of the container body 2 and maintain the engagement.

In general, operation of supplying powdery instant coffee P to the inside of the refill container 1 is performed through the opening 3C of the hopper 3.

Figure 2:
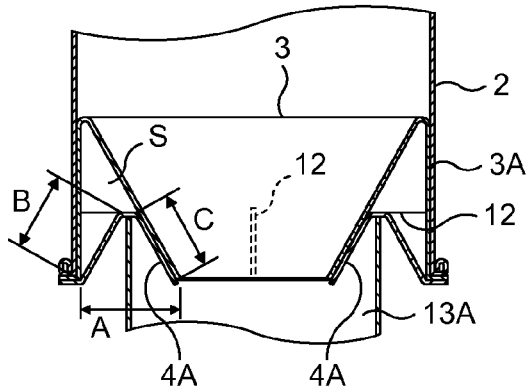
FIG. 2 is a main sectional view illustrating the feature of the invention shown in FIG. 1 and characteristically showing the relationship between the lid, the container and the jar when the lid is torn.
Figure 3:
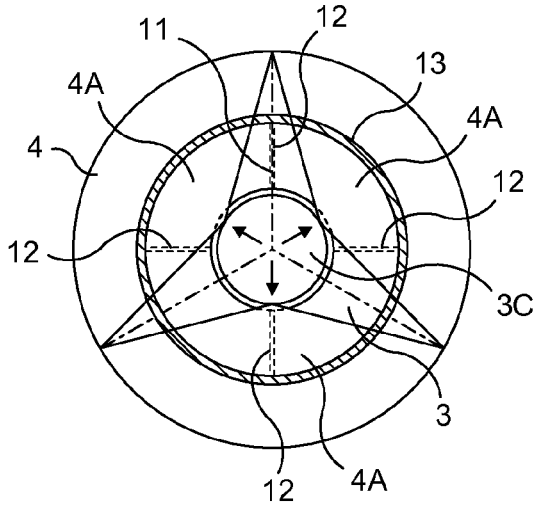
FIG. 3 is a bottom view illustrating the feature shown in FIG. 2 viewed from the jar.

Basically, in the refill container 1 having the structure mentioned above and, in particular, in this invention, four ribs 12 extending from the hopper 3 to the ring 3A are provided around the hopper 3 at predetermined, preferably equal, intervals (90 degrees in the figures) in the circumferential direction, as shown in FIGS. 1-3. Although the number of the ribs is 4 in the shown embodiment, the number is preferably at least 3 and at most 8. The thickness is equivalent to that of the hopper 3 and the ring 3A, that is, about 0.8 mm and may be smaller than this value as necessary. The material is the same as that of the container body 2 or any appropriate resin material with a thickness of 0.8 mm such as high-density polyethylene (HDPE) or polypropylene, which is natural because the ribs are formed integrally with the hopper 3 and the ring 3A. The height H from the upper ends of the ribs 12 to the upper end of the opening 3C is set to be a length of half the diameter ϕ of the opening 3C of hopper 3.

The reason for which the height H from the upper ends of the ribs 12 to the upper edge of the opening 3C of hopper 3 is set to be a length of half the diameter ϕ of the opening 3C of hopper 3 will now be explained.

As shown in FIGS. 2 and 3, when the container body 2 is mounted and pushed to a position that allows the container body 2 to internally fit with a cylindrical mouth 13A of the jar 13, which is an example of refillable containers, the lid 4 is pushed into a space S with a triangular section defined between the hopper 3 and the ring 3A on the upper end of the mouth 13A while being torn at the perforations 11. The torn pieces of the lid 4 gradually recede toward the outer periphery of opening 3C of hopper 3. The distance of receding is necessarily determined according to the distance of pushing the lid 4 into the space S with the triangular section. That is, as shown in FIGS. 1 and 2, it depends on how much distance a straight part A extending from the opening portion 2A of container body 2 to the opening 3C of hopper 3 of the lid 4 in a given sealed position is pushed into the space S with the triangular section. The pushing distance is determined by the square of a dimension B of the lid 4 from the inner edge of the opening portion 2A of container body 2 to the end of mouth 13A of jar 13 plus the square of a dimension C of the lid 4 from the distal end of this mouth 13A to the edge of opening 3C of hopper 3 subtracted by the square of the straight part A. Through analyses, it was found that the pushing length, that is, the height dimension H from the upper end of rib 12 to the upper edge of opening 3C of hopper 3 was at most half the diameter ϕ of opening 3C of hopper 3. This height H is measured between the upper end of rib 12 and the plane comprising the upper edge of opening 3C of hopper 3 that is height H is parallel to the hopper central axis. Because, when the lid 4 is torn, the torn pieces 4A gradually, radially recede from the center of the opening 3C of hopper 3, it is recommended to adopt the length of half the diameter ϕ to fully unseal the opening 3C of hopper 3. However, considering a preferable range, the minimum is a quarter of the diameter ϕ. If the height H is less than the quarter, the lid 4 is less successfully torn even if there are the weakened portions 11 such as perforations or cutting lines, whereby the unsealed area of the opening 3C of hopper 3 is reduced. Consequently, flow of the contents into the jar 13 can be hindered and the refill operation is performed smoothly. On the other hand, if the height H is more than the half, the length of hopper 3 itself is too long so that a larger amount of material is necessary, which is wasteful, and, furthermore, the size of the refill container is also large, which is not desirable.

The reason for which at least the three ribs 12 are circumferentially arranged at regular intervals is that it is possible to stably support the refill container 1 with the three ribs 12 circumferentially arranged at regular intervals when instant coffee P is transferred to a refillable container 12, as is explained later, so that it is not necessary to keep holding the refill container 1 by hand during transfer, thereby enabling smoother transfer with a one-touch operation.

However, the invention is not limited to this embodiment. For example, an alternative structure may be used in which a doughnut-shaped disk instead of the ribs 12 is provided in the space S with triangular section defined between the hopper 3 and the ring 3A at a position with a predetermined height, that is, a length of half the diameter ϕ of the opening 3C. The stability of the position of the refill container 1 during the transfer of refill is greatly improved and, necessarily, the one-touch operation of transfer is also greatly improved.

Usage of the refill container 1 constructed as previously mentioned will now be explained.

Figure 9:
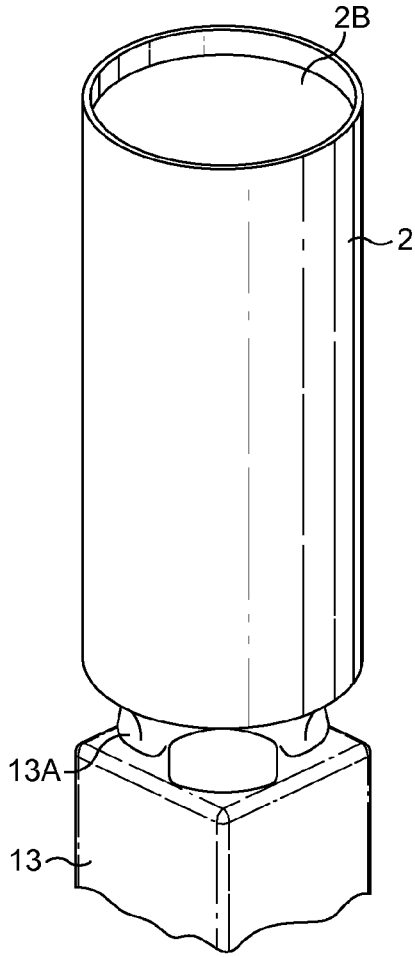
FIG. 9 is a perspective view illustrating the operation of the lid with barrier property of FIG. 1 and showing the relationship between the lid, container, and jar before contents are supplied to the jar.
Figure 10:
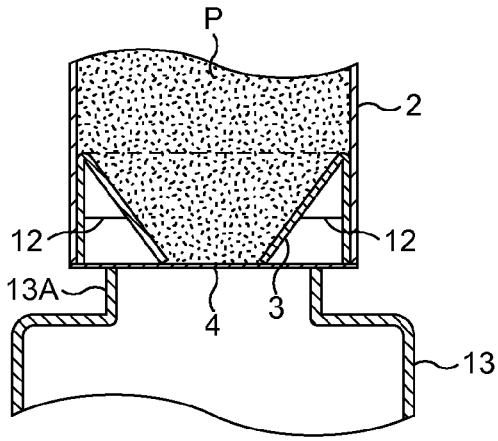
FIG. 10 is a main sectional view illustrating the operation shown in FIG. 9.
Figure 11:
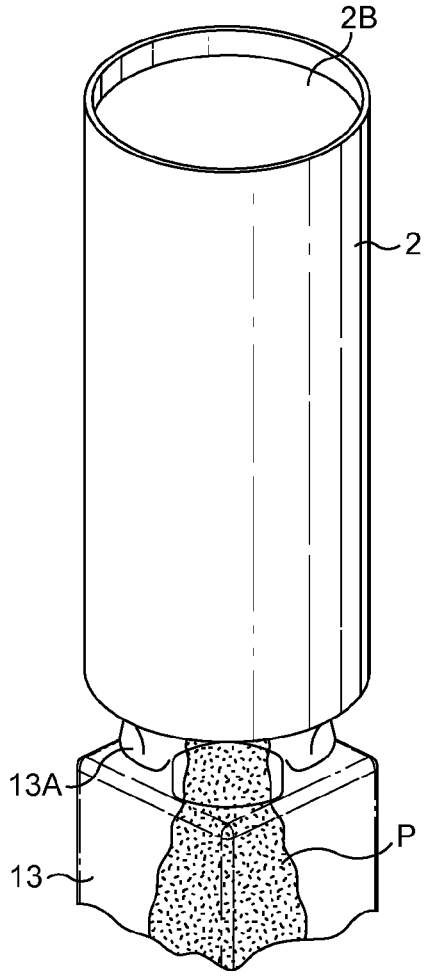
FIG. 11 is a perspective view illustrating the operation of the lid with barrier property of FIG. 1 and showing the relationship between the lid, container, and jar during supplying contents to the jar.
Figure 12:
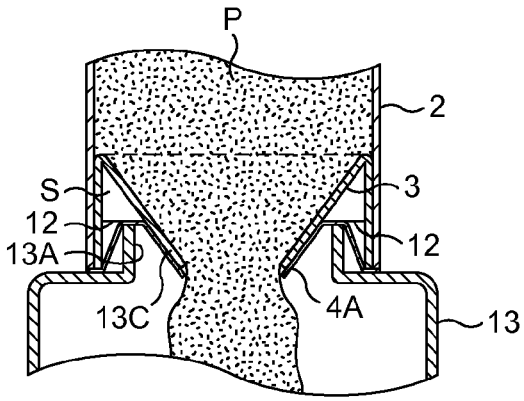
FIG. 12 is a main sectional view illustrating the operation shown in FIG. 11.

First, the overlying cap 5 is removed, then, as shown in FIGS. 1, 9 and 10, the container body 2 is inverted and placed at a position where the hopper 3 fits internally with the cylindrical mouth 13A of a jar 13 which is an example the refillable container. The instant coffee P in the container body 2 flows down into the hopper 3, but it is retained by the lid 4. Thereafter, as shown in FIGS. 2, 11 and 12, a pressing force is applied against the container body 2 so as to push the hopper 3 toward the mouth 13A of jar 13. This pressing force acts as a force allowing the mouth 13A of jar 13, which is, in general, a tubular portion cylindrically, upwardly extending from the body, to press and tear the lid 4. That is, it acts as a force allowing the mouth 13A of jar 13 to push the lid 4 upward and force the lid 4 into the space S with the triangular section defined between the hopper 3 and the ring 3A. Because the perforations which are the weakened portions 11 are provided radially, the lid 4 to which the pressing force is applied is very easily torn and divided into a plurality of division pieces, that is, the torn pieces 4A along the perforations. At the same time, the hopper 3 enters the mouth 13A of jar 13. Consequently, the opening 3C of hopper 3 is unsealed and the instant coffee P in the container body 2 flows down into the jar 13 at a stretch while it is guided to the center by the hopper 3. The refill container 1 is discarded after the refilling of the jar 13 is finished. In the figures, 2B indicates the bottom of the container body 2.

Because the instant coffee P in the container body 2 is fully sealed by the lid 4 and is not exposed to the air until it is unsealed, the airtightness of refill container 1 is highly maintained. Because the hopper 3 fitting internally with the mouth 13A of jar 13 does not spill the instant coffee P outside of the jar 13 nor expose the instant coffee P to the air unnecessarily, it is possible to prevent the aroma and the flavor from deteriorating as much as possible.

It should be noted that the torn pieces 4A of lid 4 can certainly recede from the opening 3C of hopper 3 to the outer periphery to reliably unseal the opening 3C because the height H from the upper ends of the ribs 12 to the opening 3C of hopper 3 is set in the range of a quarter to half of the opening diameter ϕ of the hopper 3. Thus, it is possible to smoothly transfer the contents from the refill container 1 to the jar 13. Furthermore, because the ribs enable the inverted position of the refill container 1 to be appropriately retained and the risk of fall to be decreased, it is possible to perform a refill operation with one action unlike the conventional pouches or gusset bags, thereby providing very useful refill containers.

Until refilling is performed, the lid 4 is tightly attached to the edge of opening 3C of hopper 3. In addition, it is further tightly attached by the pressing force from the overlying cap 5. As a result, an unnecessary gap is unlikely to be generated between the opening 3C of hopper 3 and the lid 4 and if any, the gap is small and, therefore, it is possible to successfully prevent the risk that the instant coffee P in the container body 2 moves around outside of the hopper 3. Thus, the risk of accidentally dirtying, during the refill operation, the mouth 13A of jar 13 or its neighborhood by the instant coffee P that has moved around the hopper 3 is reduced, whereby it is possible to use the refill container 1 sanitarily. In addition, since the hopper 3 is always attached to the container body 2 at a constant position by the flange 3B, it is possible to secure stable attachment, thereby enabling a refill operation to be properly performed and the moving around of the instant coffee P to be prevented more securely.

Because the curl portion 6 of opening portion 2A of container body 2 increases the strength of the opening portion 2A and reduces its deformation, it is possible to securely hold the hopper 3 with its position precisely retained as desired, thereby preventing a gap from being generated between the opening 3C of hopper 3 and the lid 4.

In the tests of the performance of the produced lid 4, its central portion was successfully torn. The pressing force was no greater than 100 N. In the test of checking the behavior of penetrant at a step 6B of the opening portion 2A in a paper cup, no leakage was observed. Furthermore, removal of the lid 4 from the opening portion 2A of the paper cup was not observed during high-temperature preservation. The barrier property of the overall lid 4 was equivalent to that of aluminum lids and a preferable result was obtained. In contrast to hot-melted lids, any bad smell was not generated.

In the embodiment described above, it is possible to adopt a structure with a partially different configuration as explained below.

Figure 13:
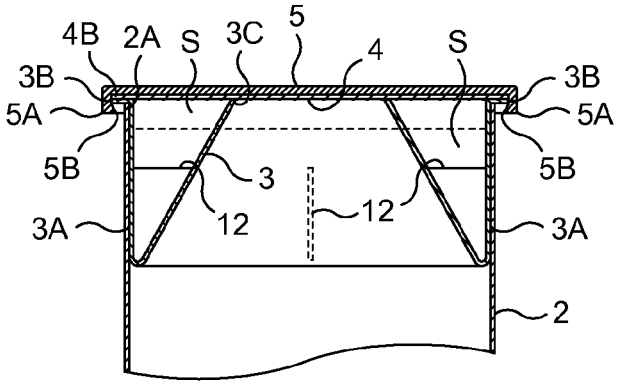
FIG. 13 is main sectional view showing an alternative embodiment that applies the invention to a container body without any curl portion.
Figure 14:
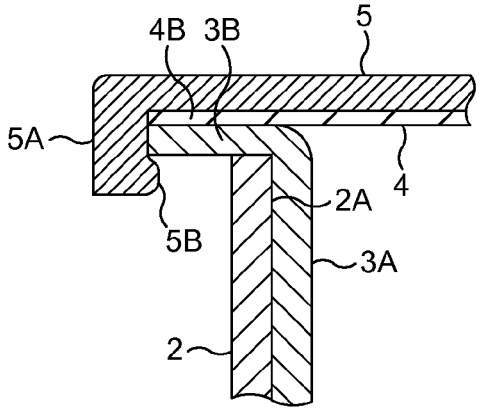
FIG. 14 is an enlarged view showing the main part of the sectional view shown in FIG. 13.

More specifically, as shown in FIGS. 13 and 14, the container body 2 without the curl portion 6 on the opening portion 2A may be used.

In this configuration, the protruding length of the flange 3B of hopper 3 is the same as that in the case where the container body 2 with the curl portion 6 is used. The vertical length of the downward wall 5A of the overlying cap 5 is shortened by the vertical length of the curl portion 6 so that the undercut 5B can elastically engages with the bottom surface of the flange 3B.

Other configurations are the same as those in the above-mentioned embodiment.

Figure 15:
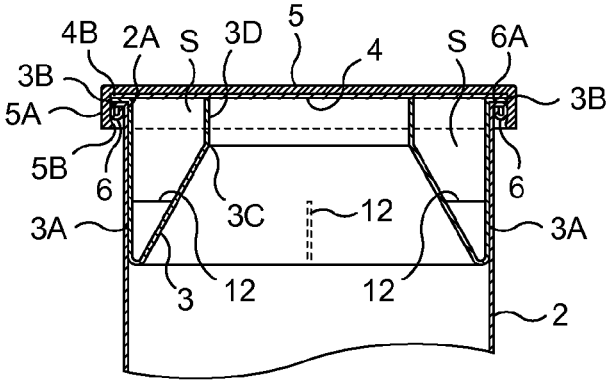
FIG. 15 is an enlarged sectional view showing the main part of another embodiment using a hopper with a tubular guide.

In an alternative structure, as shown in FIG. 15, a guide 3D that is tubular and preferably in a cylindrical shape with a constant diameter to its upper end may be provided as a tubular portion integrally with and upward from the edge of opening 3C of hopper 3. Naturally, the height of the upper end of tubular guide 3D is set to be the same as that of the flange 3B. In this embodiment, the pushing length mentioned above, and therefore, the diameter $\phi$ of opening 3C of hopper 3 which is used as a reference for determining the height position of the guide 3D are necessarily replaced with the diameter $\phi$ of the outlet of guide 3D.

Other configurations are the same as those in the above-mentioned embodiment.

The guide 3D is helpful for appropriate insertion into the mouth 13A of jar 13. For the hopper 3 having a taper only, the position where the opening 3C connects with the mouth 13A of jar 13 is likely to be out of alignment so as to accidentally spill the instant coffee P outside of the jar 13. On the other hand, for the tubular guide 3D, it is possible to insert the guide 3D through the mouth 13A into the interior of jar 13 so as to eliminate the risk of accidentally spilling the instant coffee P outside of the jar 13.

Figure 16:
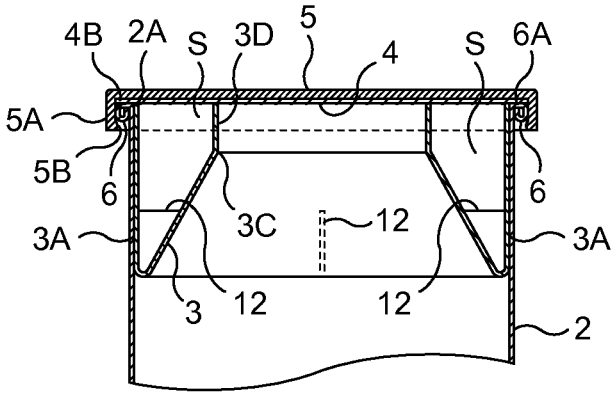
FIG. 16 is an enlarged sectional view showing a further embodiment corresponding to that of FIG. 15 without the flange on the ring.

In still another structure, as shown in FIG. 16, a hopper 3 without the flange 3B on the upper end of ring 3A is formed. In this case, it is important that the upper end of ring 3A is at the same height as the top surface of curl portion 6 of container body 2. If the upper end of ring 3A protrudes upward away from the top surface of curl portion 6, it cannot be desired that the opening portion 2A of container body 2 is appropriately sealed by the lid 4. In this embodiment, because the flange 3B is not provided on the upper end of ring 3A, the risk of exposing the atmosphere in the container body 2 to the air through the flange 3B is eliminated and reduction in quality can be preferably prevented.

Other configurations are the same as those in the above-mentioned embodiment.

In the above embodiments, the content is instant powdery coffee; however, alternatively, it is possible to apply the invention to other food or non-food powdery material, such as water-soluble milk (powdery milk), cocoa powder, tea powder, or combination of these kinds of powder. Other examples are dried mashed potatoes or other dried foods, sauce or gravy powder, soup powder, and also toner for copy machines.

Instead of the jar 13, it is possible to apply the invention to coffee powder tanks of coffer maker apparatus or refill containers for toner for copy machines.

EXAMPLE

First, a multilayer member configured of [Exterior of container] a paper layer (basis weight 300 g/m$^2$)/an adhesive layer/an aluminum foil layer (7.0 μm)/a polyethylene terephthalate layer (12 μm)/an adhesive layer/a low-density polyethylene layer (50 μm) [Interior of container] was made. Furthermore, a multilayer member configured of [Exterior of container] a low-density polyethylene layer (20 μm)/a paper layer (basis weight 230 g/m$^2$)/a low-density polyethylene layer (20 μm)/an aluminum foil layer (7.0 μm)/an adhesive layer/a polyethylene terephthalate layer (12 μm)/an adhesive layer/a low-density polyethylene layer (50 μm) [Interior of container] was made as a bottom member. These multilayer members were used to produce a cup-shaped container body having a curl portion provided circumferentially on the upper end of its middle by using a cup forming machine from PMC Inc. Thereafter, the hopper 3 having the ring 3A, flange 3B, and hopper 3C was made by injection molding using high-density polyethylene (Mitsui Chemicals 2100K). The ring 3A, flange 3B, and hopper 3C as well as the ribs 12 are molded to have a thickness of about 0.8 mm. Furthermore, a multilayer member configured of [Upper side] an aluminum foil layer as the metal foil layer 10 (15 μm)/an adhesive layer 9/the polyethylene terephthalate layer (12 μm) 8/a low-density polyethylene layer (40 μm) as the sealant layer 7 [Lower side] was made and used to produce a lid.

Then, the cup-shaped container body mentioned above was fitted into an anvil so that it supports the curl portion on the upper end of the middle from underneath and also fixes the middle part. The hopper was inserted into and attached to the opening portion inside of the upper end of the middle and the outer surface of the ring is joined to the inner surface of the opening portion.

Thereafter, the container body was filled with instant coffee through the opening of the funnel of the above-mentioned part. Finally, the above lid was thermal-fusion-bonded to the top surface of the curl portion by the heat seal method to closely seal the upper end of the container and an overlying cap was attached to the lid from above to obtain a paper container with the part.

In addition, a container body without the curl portion was produced by the method and means mentioned above.

Further, a hopper including an integral tubular guide was produced by the method and means mentioned above Furthermore, a hopper 3 without the flange 3B on the upper end of the ring 3A was made by the method and means mentioned above.

It was found that any of the obtained products were able to easily and reliably perform refilling with a very simple operation and unlikely to expose the instant coffee P to the air and that the aroma and the flavor were maintained, absolutely unlike the conventional standing pouches.

It was also found that the ribs 12 acted to securely support the refill container 1 on the upper end of the mouth 13A of jar 13 by their upper ends (lower ends in the inverted position) so that the desired, inverted position could be successfully maintained during a refill operation without a fall even if hands were released from the container 1. Furthermore, it was found that the lid 4 was desirably torn along the perforations 11 as expected at any pushing length of the lid 4 in the range from the quarter to the half as mentioned above and that the opening 3C of hopper 3 was appropriately unsealed to smoothly refill the jar 13 with the instant coffee P.

DESCRIPTION OF REFERENCE NUMERALS

1 Refill container
2 Container body
2A Opening portion
2B Bottom
3 Hopper
3A Ring
3B Flange
3C Opening
3D Guide
4 Lid
4A Torn pieces
4B Periphery
5 Overlying cap
5A Peripheral downward wall
5B Undercut
6 Curl portion
6A Upper end face
7 Sealant layer
8 Adhesive layer
9 Adhesion layer
10 Metal foil layer
12 Rib
13 Jar
13A Opening

The invention claimed is:

1. A refillable container comprising:

a container body having an opening portion;

a hopper assembly positioned integrally on the opening portion of the container body comprising a hopper tapering toward the container opening portion and the hopper assembly having ribs extending from an outer circumferential wall of the hopper assembly to the inner tapering wall of the hopper and arranged circumferentially at intervals, the height from an upper ends of the ribs to an upper edge of the hopper opening is at least a quarter of the diameter ϕ of the hopper opening; and a tearable sealing lid closing the container body opening portion.

2. The container according to claim 1, wherein the hopper is positioned integrally with a tubular member on the end of its tapered opening, the tubular member extending axially with the same internal diameter ϕ as an end of the tapered opening.

3. The container according to claim 1, wherein the outer circumferential wall of the hopper assembly is a ring, the ring having an outer shape with a dimension that is the same as the inner diameter of the container opening portion, thereby enabling the hopper to be mounted by attaching the ring to the inner surface of the container opening portion.

4. The container according to claim 3, wherein the ring is attached on an edge of the hopper that is nearer to the interior of the container body.

5. The container according to claim 1, wherein the hopper assembly is made of a material selected from the group consisting of paper and resin material.

6. The container according to claim 1, wherein the hopper assembly has a thickness of 0.8 mm.

7. The container according to claim 1, wherein the hopper assembly comprises 3 to 8 ribs.

8. The container according to claim 1, wherein the ribs are formed integrally with the hopper and the outer circumferential wall.

* * * * *